US010287902B2

(12) United States Patent
Sak et al.

(10) Patent No.: US 10,287,902 B2
(45) Date of Patent: May 14, 2019

(54) VARIABLE STATOR VANE UNDERCUT BUTTON

(71) Applicant: General Electric Company, Schenectady, NY (US)

(72) Inventors: Wojciech Sak, West Chester, OH (US); Timothy William Taylor, Cincinnati, OH (US); Walter Glen Crosby, IV, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 466 days.

(21) Appl. No.: 14/989,088

(22) Filed: Jan. 6, 2016

(65) Prior Publication Data

US 2017/0191367 A1 Jul. 6, 2017

(51) Int. Cl.
*F01D 9/04* (2006.01)
*F01D 17/16* (2006.01)
*F04D 29/56* (2006.01)

(52) U.S. Cl.
CPC ..... *F01D 9/041* (2013.01); *F01D 17/162* (2013.01); *F04D 29/563* (2013.01);
(Continued)

(58) Field of Classification Search
CPC ..... F01D 9/041; F01D 17/162; F01D 17/16; F01D 17/14; F01D 17/12; F04D 29/563;
(Continued)

(56) References Cited

U.S. PATENT DOCUMENTS 4,231,703 A 11/1980 Weiler
6,283,705 B1 9/2001 Rice et al.
(Continued)

FOREIGN PATENT DOCUMENTS

CN 102454431 A 5/2012
DE 10 2009 004 933 A1 7/2010
(Continued)

OTHER PUBLICATIONS

Extended European Search Report and Opinion issued in connection with corresponding EP Application No. 17150165.3 dated May 12, 2017.
(Continued)

*Primary Examiner* — Richard A Edgar
(74) *Attorney, Agent, or Firm* — General Electric Company; Pamela Kachur

(57) ABSTRACT

A variable stator vane includes airfoil mounted to a button centered about a rotational axis and having cylindrical portion supporting airfoil and a button undercut extending away from cylindrical portion and radially inwardly from circumference of cylindrical portion. Conical portion of button circumscribed about conical axis of revolution extends away from cylindrical portion. Conical axis of revolution may be tilted with respect to and may intersect rotational axis. Airfoil may include airfoil overhang extending radially outwardly beyond circular trailing edge of button. Variable stator vane may include airfoil disposed between spaced apart outer and inner buttons centered about a rotational axis, inner button having a cylindrical portion supporting airfoil and circumscribed about rotational axis, and button undercut extending away from cylindrical portion and radially inwardly from a circumference of cylindrical portion with respect to rotational axis. Outer and inner spindles extend from outer and inner buttons and airfoil.

7 Claims, 6 Drawing Sheets

(52) U.S. Cl.
CPC .... *F05D 2220/32* (2013.01); *F05D 2250/232* (2013.01); *F05D 2250/90* (2013.01)

(58) Field of Classification Search
CPC ..... F05D 2220/32; F05D 2250/232; F05D 2250/90
See application file for complete search history.

(56) References Cited

U.S. PATENT DOCUMENTS

| | | | | |
|---|---|---|---|---|
| 6,435,821 | B1 | 8/2002 | Nicolson et al. | |
| 6,461,105 | B1 | 10/2002 | Nicolson | |
| 6,843,638 | B2 | 1/2005 | Hidalgo et al. | |
| 7,806,652 | B2 * | 10/2010 | Major | F01D 5/147 415/160 |
| 8,123,471 | B2 | 2/2012 | Mielke et al. | |
| 2008/0131268 | A1 * | 6/2008 | Guemmer | F01D 17/162 415/160 |
| 2010/0232936 | A1 | 9/2010 | Mielke et al. | |

FOREIGN PATENT DOCUMENTS

| | | | | |
|---|---|---|---|---|
| DE | 102009004933 | A1 * | 7/2010 | F01D 17/162 |
| EP | 0 965 727 | A2 | 12/1999 | |
| EP | 1 262 635 | A1 | 4/2002 | |

OTHER PUBLICATIONS

Machine Translation and First Office Action issued in connection with corresponding CN Application No. 201710009798.X dated Feb. 23, 2018.

* cited by examiner

VARIABLE STATOR VANE UNDERCUT BUTTON

BACKGROUND OF THE INVENTION

Technical Field

This invention relates to aircraft gas turbine engines and, particularly, to variable stator vane buttons.

Background Information

Variable stator vanes (VSVs) are known to be used in aircraft gas turbine engine low and high pressure compressors and fans and in some turbine designs. Non-rotating or stationary stator vanes typically are placed downstream or upstream of rotor blades of the fans, compressors, and turbines.

Due to the large range of operating conditions experienced by an axial flow HPC over a typical operating cycle, flow rates and rotational speeds of the compressor also vary widely. This results in large shifts in the absolute flow angle entering the stator vanes. To allow the vanes to accommodate these shifts in flow angle without encountering high loss or flow separation, circumferential rows of variable stator vanes are constructed so that the vanes can be rotated about their radial (or approximately radial) axis.

Generally, variable stator vanes (VSVs) have spindles through their rotational axis that penetrate the casing, allowing the vanes to be rotated using an actuation mechanism. At the flowpath, there will typically be a button of material around the spindle which rotates along with the vane. However, the size of this button is normally limited by the pitchwise spacing of the VSVs, resulting in a portion of the vane chord at the endwalls where a gap exists between the flowpath and the vane.

Because there is a large pressure gradient between the pressure and suction sides of the vane, leakage flow is driven across this gap, resulting in reduced fluid turning and higher loss at the endwalls. This leakage flow also causes flow non-uniformities (i.e. wakes) at the adjacent rotor blades, which may excite these blades causing potentially damaging vibrations in the rotor blades. It is thus desirable to reduce the chordwise extent of this gap and the accompanying leakage flow. To this end, VSV buttons have been designed to cover inner and outer diameter ends of the VSV airfoil. The coverage of the ends is desirable because it minimizes endwall losses due to leakage flow at the endwall gap between the vanes and the walls of the flow passageway.

Conventional VSV buttons typically have diameters equal to or slightly less than the pitchwise spacing between vanes at their respective locations. This is because larger buttons would overlap with one another, making it physically impossible to fit the vane assemblies together. In some cases, designers have specified flats or arched cuts on the sides of the buttons to allow the use of larger button diameters, thereby achieving greater endwall coverage. However, these configurations typically result in large cavities between buttons and often have large flowpath gaps near the vane leading edges leading to undesirable losses and large wakes. High pressure compressors HPC VSVs with highly sloped inner flowpaths have buttons with a maximum diameter of the upper surface of the inner button limited by the interference at the bottom of the button. This limits the size of a cylindrical button.

Thus, it is highly desirable to provide buttons which minimize endwall leakage and operate over a wide range of vane angle settings.

BRIEF DESCRIPTION OF THE INVENTION

A variable stator vane includes an airfoil mounted to a biconic button centered about a rotational axis, the button has a cylindrical portion supporting the airfoil and circumscribed about the rotational axis, and a button undercut extends away from the cylindrical portion and radially inwardly from a circumference of the cylindrical portion with respect to the rotational axis. The button undercut may include a conical portion extending away from the cylindrical portion and being circumscribed about a conical axis of revolution which may be tilted with respect to and may intersect the rotational axis.

The airfoil may include an airfoil overhang extending radially outwardly beyond a circular trailing edge of the button.

A variable stator vane includes an airfoil disposed between spaced apart outer and inner buttons centered about a rotational axis, the inner button having a cylindrical portion supporting the airfoil and circumscribed about the rotational axis, and a button undercut extending away from the cylindrical portion and radially inwardly from a circumference of the cylindrical portion with respect to the rotational axis.

Outer and inner spindles may extend away from the outer and inner buttons respectively and the airfoil. The airfoil may extend from a base of the airfoil on the inner button and a fillet between the airfoil and the inner button may extend around the base and the airfoil.

A gas turbine engine variable vane assembly includes at least one circular row of variable stator vanes, the variable stator vanes include airfoils disposed between spaced apart outer and inner buttons centered about rotational axes, the inner buttons having cylindrical portions supporting the airfoils and circumscribed about the rotational axes, and button undercuts extending away from the cylindrical portions and radially inwardly from circumferences of the cylindrical portions with respect to the rotational axes.

The inner button may be rotatably disposed in inner circular recesses in an inner ring and connecting recesses in the inner ring may circumferentially connect adjacent ones of the inner circular recesses.

DETAILED DESCRIPTION OF THE INVENTION

Figure 1:
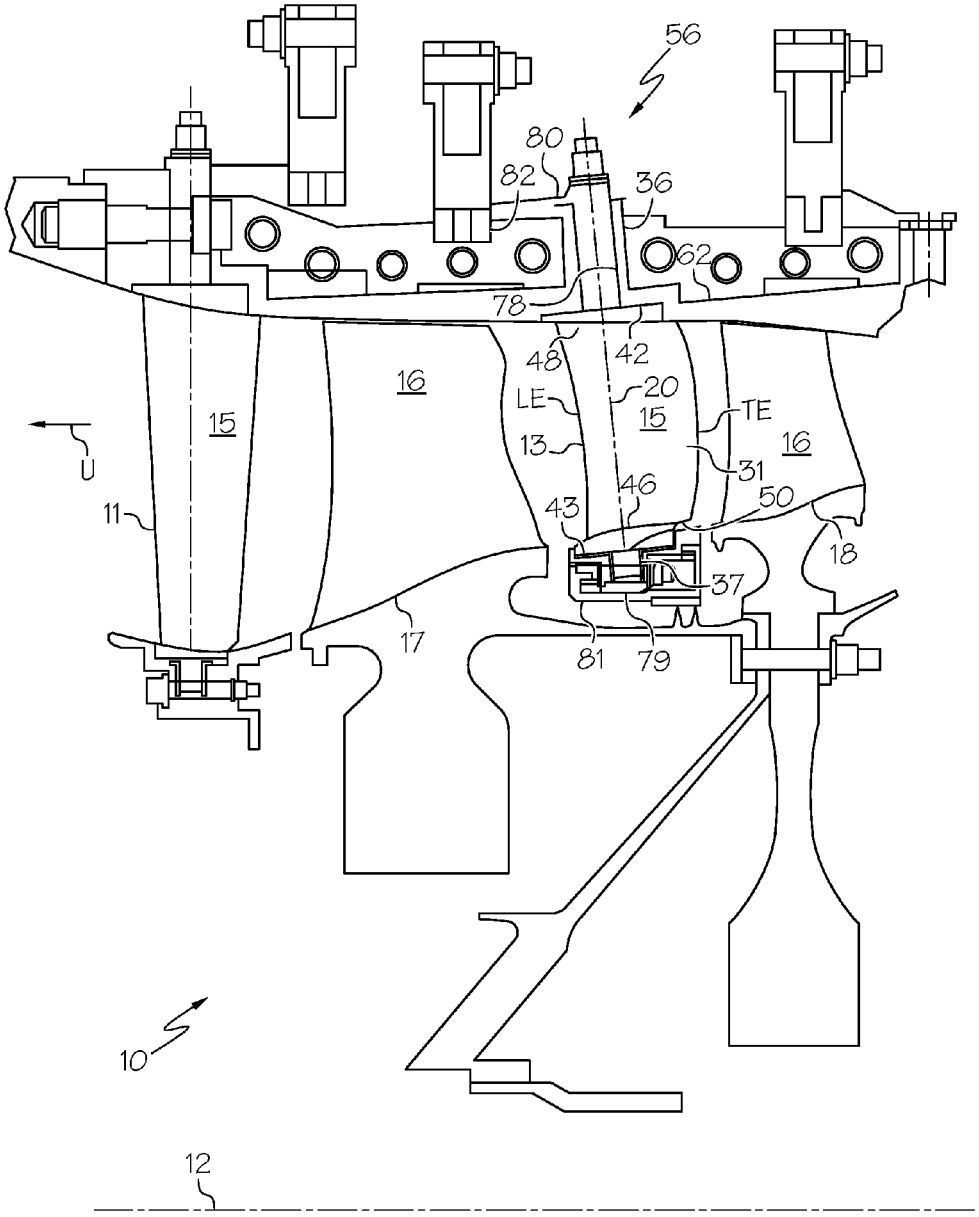
FIG. 1 is a sectional view illustration of a portion of a gas turbine engine high pressure compressor with variable stator vanes with undercut buttons.

Illustrated in FIG. 1 is a portion of an exemplary turbofan gas turbine engine high pressure compressor 10 circumscribed about a longitudinal or axial centerline axis 12. Circular first and second rows 11, 13 of variable stator vanes 15 (VSVs) are disposed in the compressor 10 and used to optimize the direction at which gases flowing through the compressor 10 enter first and second rows 17, 18 of rotatable blades 16. Though the exemplary embodiment of the VSVs disclosed herein is for a high pressure compressor, the VSV's may be used in other compressor sections and in fan and turbine sections of a gas turbine engine as well. An outer compressor casing 62 supports variable stator vane assemblies 56 which include the variable stator vanes 15.

Figure 2:
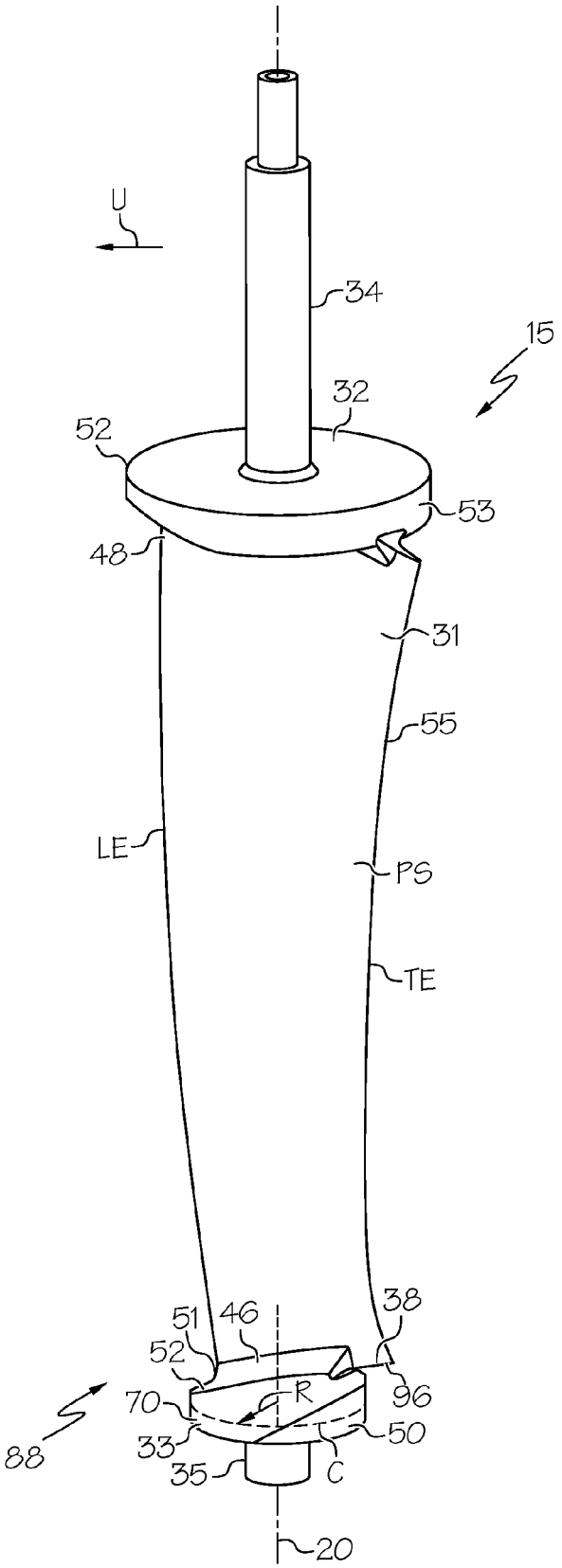
FIG. 2 is a perspective view illustration of one of the compressor variable stator vanes with the undercut button illustrated in FIG. 1.
Figure 3:
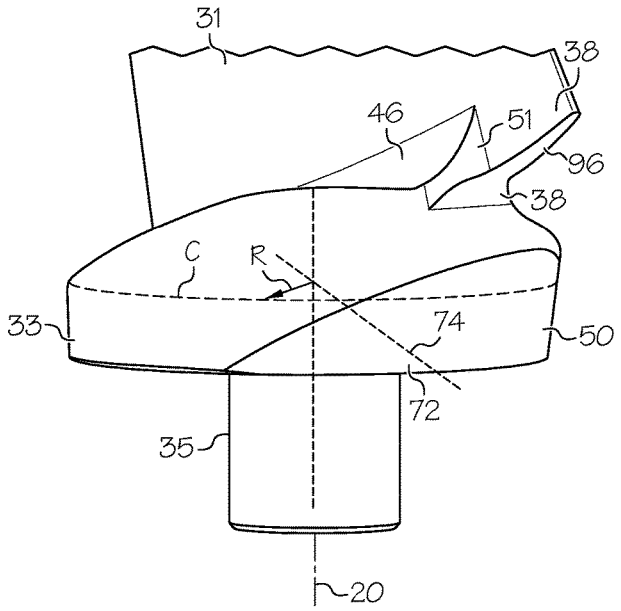
FIG. 3 is an enlarged perspective view illustration of the undercut button illustrated in FIG. 2.

Referring to FIGS. 2-3, each variable stator vane assembly 56 includes a plurality of variable stator vanes 15. Each variable stator vane 15 is pivotable or rotatable about a rotational axis 20. Each variable stator vane 15 has an airfoil 31 disposed between spaced apart outer and inner buttons 32, 33. An outer spindle 34 extends outwardly from the outer button 32 and an inner spindle 35 extends inwardly from the inner button 33. The outer and inner spindles 34, 35 are rotatably supported in outer and inner trunnions 36, 37 respectively as illustrated in FIG. 1.

Referring to FIG. 1, the outer spindle 34 is rotatably disposed through the outer trunnion 36 which, in turn, is mounted in an outer opening 78 in the casing 62. The inner spindle 35 is rotatably disposed through the inner trunnion 37 which, in turn, is mounted in and through an inner opening 79 or hole in an inner ring 81 which is spaced radially inwardly of the casing 62. A lever arm 80 extends from the outer spindle 34 and is linked to an actuation ring 82 for rotating or pivoting and setting the flow angle of the variable stator vanes 15.

Referring to FIGS. 1 and 2, the outer and inner buttons 32, 33 are rotatably disposed in outer and inner circular recesses 42, 43 in the casing 62 and the inner ring 81 respectively. Each airfoil 31 has an airfoil leading edge LE upstream U of an airfoil trailing edge TE and pressure and suction sides PS, SS. The trailing edge TE extends downstream past the outer and inner buttons 32, 33. Each airfoil 31 extends outwardly from a base 46 on the inner button 33 to a tip 48 on the outer button 32. The base 46 is connected to the inner button 33 by a root 38. A root 38 extends around the base 46 and the airfoil 31. A fillet 51 between the inner button 33 and the airfoil 31 extends around the base 46 and airfoil 31. Referring to FIG. 2, the outer and inner buttons 32, 33 each have circular leading and trailing edges 52, 53 near the airfoil leading and trailing edges LE, TE and the circular leading edge 52 is upstream of the circular trailing edge 53.

Referring to FIGS. 2 and 3, the inner button 33 is biconic having a cylindrical portion 70 supporting the airfoil 31 and is circumscribed about the rotational axis 20 at a button radius R. A button undercut 50 extends radially away from the cylindrical portion 70 with respect to the rotational axis 20 and may not be symmetrical about the rotational axis 20 as illustrated herein. The button undercut 50 extends inwardly from a circumference C of the cylindrical portion 70 with respect to the rotational axis 20. The exemplary embodiment of the button undercut 50 illustrated herein is a conical portion 72 extending away from the cylindrical portion 70 and is circumscribed about a conical axis of revolution 74. The conical axis of revolution 74 is tilted with respect to and may intersect the rotational axis 20 as illustrated in the exemplary embodiment of the undercut button herein.

The button undercut 50 allows for the use of a larger diameter DI (see FIG. 6) for the cylindrical portion 70 of the inner button 33. Larger diameter buttons allow reduction of airfoil overhang 96 which is the amount of VSV airfoil 31 that is unsupported off the circular trailing edge 53 of the inner button 33. This reduction of airfoil overhang 96 increases airfoil 31 stiffness and diminishes the potential for locally high modal stresses in the inner button 33 region. Enlarging the inner button 33 by utilizing button undercuts 50 maintains the cylindrical geometry at the flowpath surface, thus, maintaining an aero desired flowpath shape by not introducing any additional gaps or steps.

The larger buttons will allow the use of smaller fillets and root thickness, thus, allowing more flexibility in designing the airfoil to be more aerodynamically closer to the shape desired by aerodynamic designers. This provides better aerodynamic efficiency. Highly sloped flowpaths creates a condition where the cylindrical button shape forces more separation between buttons and the undercuts help reduce this separation.

Figure 4:
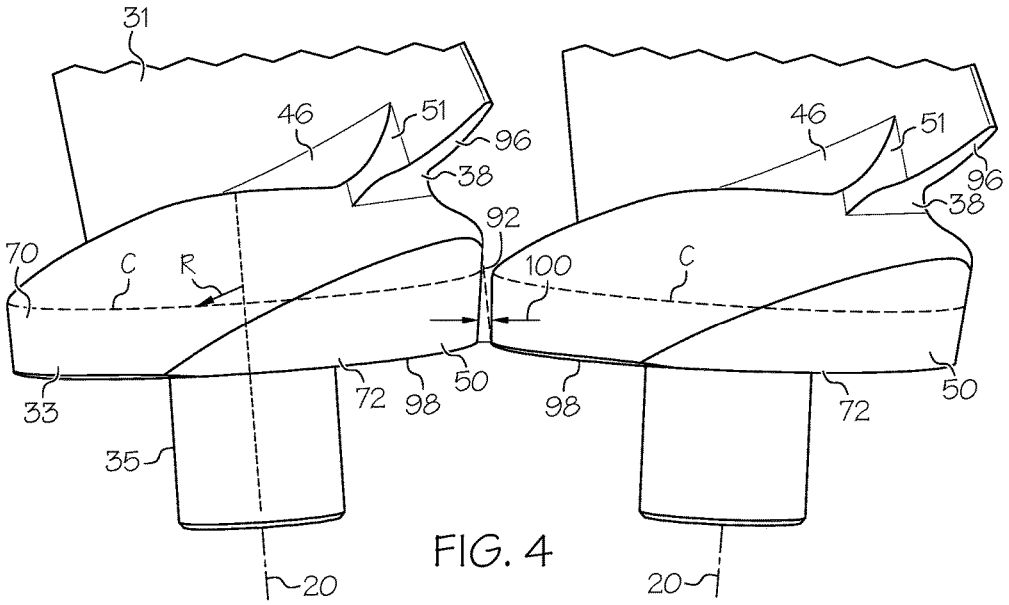
FIG. 4 is a perspective view illustration of two adjacent undercut buttons illustrated in FIG. 3.
Figure 8:
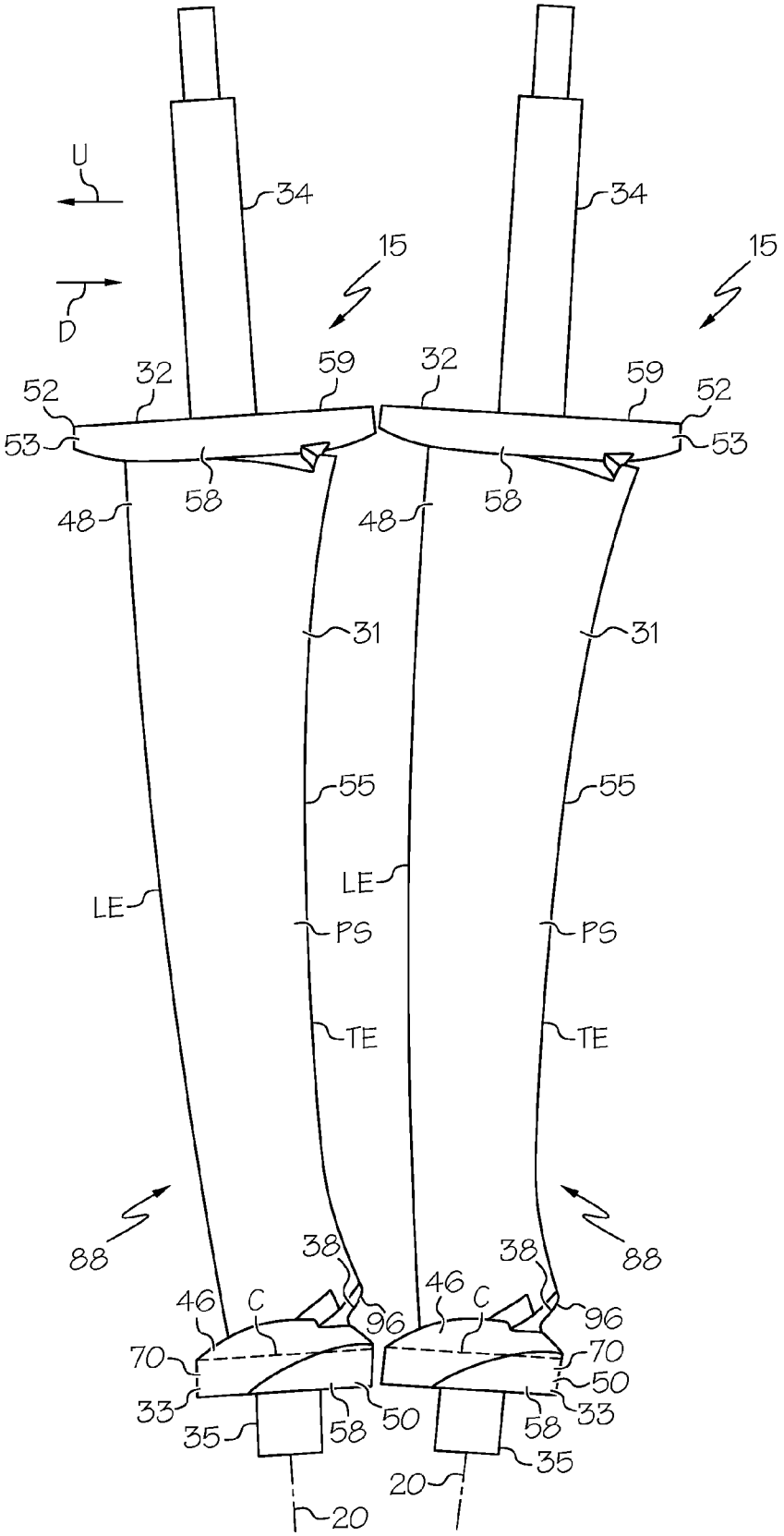
FIG. 8 is a diagrammatic perspective aft looking forward view illustration of two adjacent compressor variable stator vanes with the undercut button illustrated in FIG. 2.

FIG. 4 illustrates a pair 98 of circumferentially adjacent inner buttons 33 of a pair of circumferentially adjacent VSVs 88 illustrated in FIG. 8. FIG. 4 also illustrates a button spacing 100 between the pair 98 of circumferentially adjacent inner buttons 33. The button undercut 50 of a first one 102 of adjacent inner buttons 33 is separated from the cylindrical portion 70 of a second one 104 of adjacent inner buttons 33 by the spacing 100. Without the button undercut 50, the cylindrical portion 70 of the first one 102 would interfere with the cylindrical portion 70 of the second one 104 of adjacent inner buttons 33 as illustrated in FIG. 4 by the dotted line phantom cylindrical extension 92.

Figure 5:
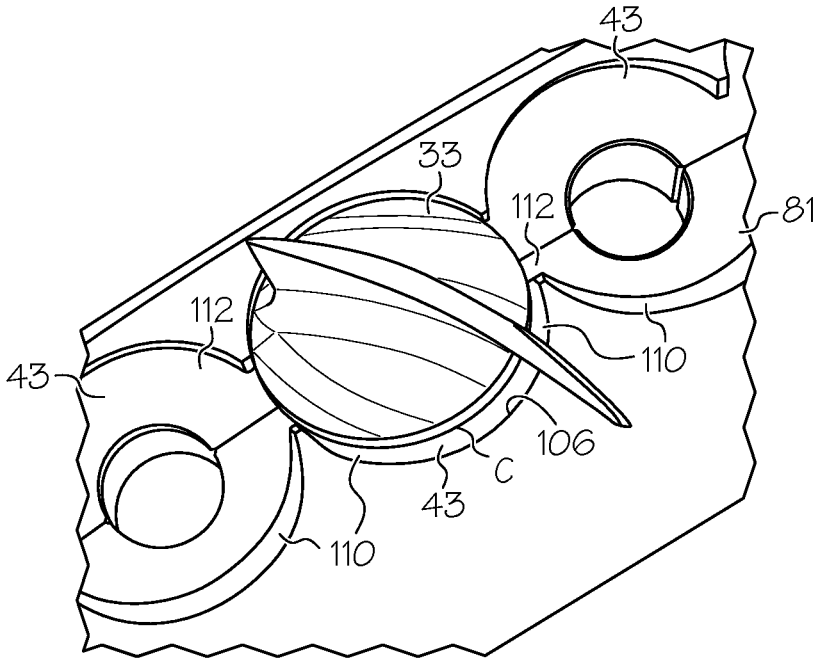
FIG. 5 is a diagrammatic perspective view illustration of button recesses in an inner ring on either side of the undercut button illustrated in FIG. 3.
Figure 6:
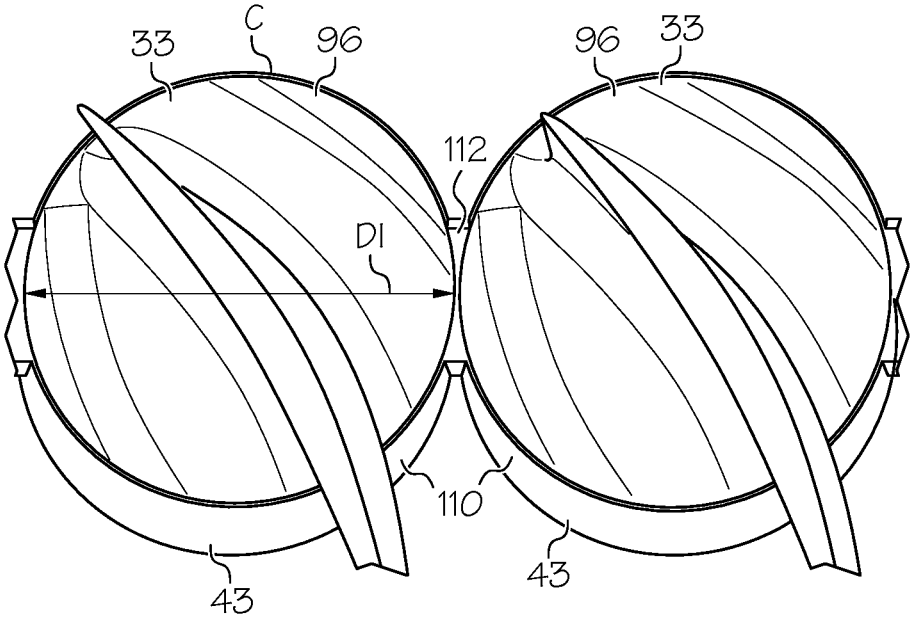
FIG. 6 is a diagrammatic perspective top looking down view illustration of two adjacent undercut buttons in adjacent button recesses in the inner ring illustrated in FIG. 5.
Figure 7:
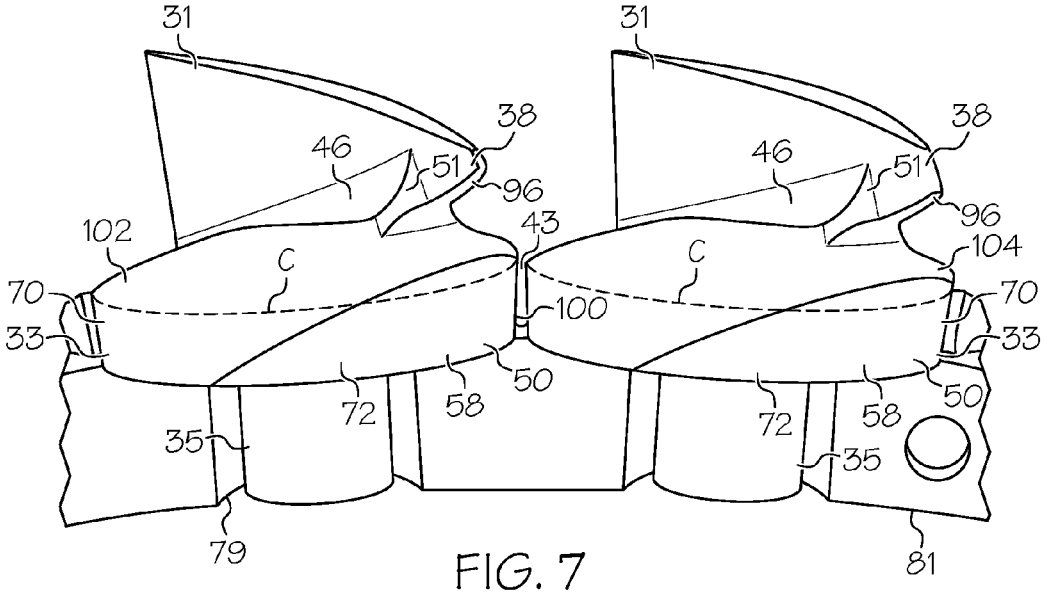
FIG. 7 is a diagrammatic perspective aft looking forward view illustration of the two adjacent undercut buttons in adjacent button recesses in the inner ring illustrated in FIG. 6.

Illustrated in FIGS. 5 and 6 are three adjacent inner circular recesses 43 in the inner ring 81. One of the inner buttons 33 is illustrated in a middle one 106 of the three adjacent inner circular recesses 43. Each adjacent two or pair 110 of adjacent inner circular recesses 43 are connected circumferentially by a connecting recess 112 as illustrated in FIGS. 5 and 6. This allows the pair 98 of circumferentially adjacent inner buttons 33 to be rotatably disposed in the pair 110 of adjacent recesses 43 in the inner ring 81 as illustrated in FIGS. 6 and 7. This also allows for larger buttons with larger circumferences C because the circumferences C of the cylindrical portions 70 of the pair 98 of circumferentially adjacent inner buttons 33 can overlap and still maintain a clearance (indicated by the spacing 100) between the cylindrical portions 70 of the pair 98. The button undercut 50 of a first one 102 of adjacent inner buttons 33 is separated from the cylindrical portion 70 of a second one 104 of adjacent inner buttons 33 by the spacing 100.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A gas turbine engine variable vane assembly comprising:

at least one circular row of variable stator vanes, the variable stator vanes including airfoils disposed between spaced apart outer and inner buttons centered about rotational axes, the inner buttons having cylindrical portions supporting the airfoils and circumscribed about the rotational axes, button undercuts extending away from the cylindrical portions and radially inwardly from circumferences of the cylindrical portions with respect to the rotational axes, the inner buttons rotatably disposed in inner circular recesses in an inner ring and connecting recesses in the inner ring circumferentially connecting adjacent ones of the inner circular recesses; and the button undercuts including conical portions extending away from the cylindrical portions and being circumscribed about conical axes of revolution of the variable stator vanes.

2. An assembly as claimed in claim 1, further comprising the conical axes of revolution tilted with respect to the rotational axes.

3. An assembly as claimed in claim 2, further comprising the conical axes of revolution intersecting the rotational axes.

4. An assembly as claimed in claim 2, further comprising:

the airfoils including airfoil overhangs extending radially outwardly beyond circular trailing edges of the inner buttons, outer spindles extending away from the outer buttons and the airfoils, and inner spindles extending away from the inner buttons and the airfoils.

5. An assembly as claimed in claim 4, further comprising the inner spindles disposed through inner openings in the inner ring.

6. An assembly as claimed in claim 4, further comprising the airfoils extending from bases of the airfoils on the inner buttons and fillets between the airfoils and the inner buttons extending around the bases and the airfoils extend and the airfoils.

7. An assembly as claimed in claim 5, further comprising the outer spindles disposed through outer openings in a casing supporting the variable stator vanes.

* * * * *